US011104554B2

(12) United States Patent
Italiano

(10) Patent No.: US 11,104,554 B2
(45) Date of Patent: Aug. 31, 2021

(54) FOLDABLE GANTRY

(71) Applicant: REID LIFTING LIMITED, Monmouthshire (GB)

(72) Inventor: Peter Italiano, Chepstow (GB)

(73) Assignee: REID LIFTING LIMITED, Chepstow (GB)

( * ) Notice: Subject to any disclaimer, the term of this patent is extended or adjusted under 35 U.S.C. 154(b) by 0 days.

(21) Appl. No.: 16/522,485

(22) Filed: Jul. 25, 2019

(65) Prior Publication Data

US 2020/0071137 A1 Mar. 5, 2020

Related U.S. Application Data

(63) Continuation of application No. 14/117,836, filed as application No. PCT/GB2012/051102 on May 16, 2012, now Pat. No. 10,399,827.

(30) Foreign Application Priority Data

May 18, 2011 (GB) ..... 1108335

(51) Int. Cl.

| | |
|---|---|
| ***B66C 19/02*** | (2006.01) |
| ***B25H 1/06*** | (2006.01) |
| *B66C 9/08* | (2006.01) |

(52) U.S. Cl.

CPC ..... *B66C 19/02* (2013.01); *B25H 1/06* (2013.01); *B66C 9/08* (2013.01)

(58) Field of Classification Search

CPC .... B25H 1/02; B25H 1/04; B25H 1/06; B66C 19/02

See application file for complete search history.

(56) References Cited

U.S. PATENT DOCUMENTS

| | | | | |
|---|---|---|---|---|
| 1,116,272 A | | 11/1914 | Haselton | |
| 1,239,524 A | | 9/1917 | Root | |
| 1,411,733 A | | 4/1922 | Kimball | |
| 1,426,536 A | | 8/1922 | Elmo | |
| 1,450,492 A | | 4/1923 | Maurice | |
| 1,725,168 A | * | 8/1929 | Willis | E04G 1/38 182/225 |
| 1,798,548 A | | 3/1931 | McCurdy | |
| 1,823,871 A | | 9/1931 | Beasley | |
| 2,702,727 A | | 2/1955 | Sweet | |
| 2,744,794 A | | 5/1956 | Byl | |

(Continued)

FOREIGN PATENT DOCUMENTS

| | | |
|---|---|---|
| DE | 4332675 A1 | 3/1995 |
| EP | 1101480 A2 | 5/2001 |

(Continued)

OTHER PUBLICATIONS

UK Search Report dated Sep. 14, 2011 as received in GB1108335.9, 3 pgs.

(Continued)

*Primary Examiner* — Colleen M Chavchavadze
(74) *Attorney, Agent, or Firm* — Maschoff Brennan

(57) ABSTRACT

A foldable gantry comprising a beam and a first leg assembly, the first leg assembly being pivotally mounted at a first end of the beam such that the first leg assembly can move between a first, stowed, position and a second, deployed, position.

10 Claims, 9 Drawing Sheets

(56) References Cited

U.S. PATENT DOCUMENTS 2,755,144 A * 7/1956 Simmons ..... B25H 1/06 182/155
3,483,999 A * 12/1969 *Barrett ..... A47F 5/13 211/204
3,494,492 A * 2/1970 Thiermann ..... B66C 19/02 414/461
3,738,451 A 6/1973 Kirkpatrick
3,741,338 A 6/1973 Durand et al.
3,826,196 A * 7/1974 Wallace ..... B66C 19/02 104/126
3,934,676 A 1/1976 Rice
3,978,943 A * 9/1976 Greenman ..... B25H 1/06 182/155
4,256,300 A * 3/1981 Boucher ..... A63G 9/00 182/155
4,334,480 A * 6/1982 Wallace ..... B66C 19/02 104/126
4,605,099 A 8/1986 Crum
4,640,386 A * 2/1987 Hall ..... B25H 1/06 182/155
4,648,778 A 3/1987 Schultz
4,690,248 A 9/1987 Killeen
4,754,844 A * 7/1988 Sutton ..... B25H 1/06 182/155
4,770,273 A 9/1988 McMakin et al.
4,836,332 A 6/1989 Henson
4,972,924 A 11/1990 Neilsen
5,102,078 A 4/1992 Nordeng
5,427,356 A 6/1995 Krotov
5,660,121 A 8/1997 Botts et al.
5,816,646 A * 10/1998 Combest ..... B60P 3/36 296/163
6,131,749 A * 10/2000 Crockett ..... B60R 7/10 211/105.3
6,161,807 A * 12/2000 Steiner ..... F16M 11/046 182/181.1
6,464,208 B1 10/2002 Smith
6,564,903 B2 * 5/2003 Krajec ..... B25H 1/06 182/153
6,935,462 B2 * 8/2005 Remmers ..... B25H 1/06 182/153
7,448,608 B2 * 11/2008 Radermacher ..... B23D 47/025 144/267
7,458,403 B2 * 12/2008 Radermacher ..... B23D 47/025 144/286.1
8,526,802 B1 * 9/2013 Starns ..... G03B 17/561 396/1
8,727,146 B2 5/2014 Radmalll
8,739,990 B2 * 6/2014 Radmall ..... B66C 19/02 212/324
8,931,529 B2 1/2015 Fregeau
9,316,019 B2 * 4/2016 Buckley ..... E04H 15/46
10,577,227 B1 * 3/2020 Napieralski ..... B60P 1/5461
2004/0250903 A1 * 12/2004 Welsh ..... B25H 1/06 144/286.5
2008/0196632 A1 8/2008 Achterberg
2013/0285302 A1 10/2013 Helm

FOREIGN PATENT DOCUMENTS

EP 2174756 A1 * 4/2010 ..... B25H 1/06
FR 2221388 A1 11/1974
JP 2004-026506 A 1/2004
JP 2004-043038 A 2/2004

OTHER PUBLICATIONS

International Search Reports and Written Opinion dated Aug. 21, 2012 as received in PCT/GB2012/051102.

* cited by examiner

FOLDABLE GANTRY

TECHNICAL FIELD

The present invention relates to a foldable gantry.

BACKGROUND TO THE INVENTION

Gantries are used in a variety of lifting applications where objects are to be lifted using a hoist that is mounted for horizontal movement along a beam of the gantry. Typically gantries have a pair of legs on which a horizontal beam is mounted, with the hoist being mounted on the horizontal beam by means of a ring which depends from a trolley which is mounted for movement along the beam. The height of the beam may be adjustable, for example by adjusting the length of the legs, and the legs may be mounted on castors, wheels or the like to permit movement of the gantry.

Because of their construction gantries of this type are typically cumbersome and difficult to manoeuvre, transport and store. Transporting or storing a gantry in its fully assembled state can be difficult because of the size of the gantry. Some gantries can be disassembled for transportation and storage, for example by detaching the beam from the legs, and reassembled at the destination where they are to be used. This approach is time-consuming as it requires the disassembly and subsequent reassembly of the gantry, and also has safety implications, as it is possible for the gantry to be reassembled incorrectly.

Accordingly there is a desire for a gantry that is easy to manoeuvre and can quickly and easily be transported between locations and stored, without requiring time-consuming and potentially unsafe disassembly and subsequent reassembly.

SUMMARY OF INVENTION

According to a first aspect of the present invention there is provided a foldable gantry comprising a beam and a first leg assembly, the first leg assembly being pivotally mounted at a first end of the beam such that the first leg assembly can move between a first, stowed, position and a second, deployed, position.

The foldable gantry of the present invention provides an improvement over prior art gantries in that it can quickly, easily and safely be converted between a compact stowed configuration for storage or transport and a deployed configuration for use.

The foldable gantry may further comprise a second leg assembly, the second leg assembly being pivotally mounted at a second end of the beam such that the second leg assembly can move between a first, stowed, position and a second, deployed, position.

A pivot point of the second leg assembly may be offset with respect to a pivot point of the first leg assembly such that when the first and second leg assemblies are in their first, stowed, positions the second leg assembly abuts the beam and the first leg assembly abuts the second leg assembly.

This arrangement permits the first and second leg assemblies to fold down in such a way that one overlies the other, thus increasing the compactness of the foldable gantry in its stowed configuration, which in turn facilitates handling of the gantry.

The first leg assembly may comprise an upper leg part and a pair of lower leg parts, the lower leg parts being moveable between a first, stowed, position and a second, deployed, position.

Similarly, the second leg assembly may comprise an upper leg part and a pair of lower leg parts, the lower leg parts being moveable between a first, stowed, position and a second, deployed, position.

The arrangement of the leg assemblies further increases the compactness of the foldable gantry in its stowed configuration, as the lower leg parts can be stowed to minimise the outward width of the gantry in its stowed configuration, which in turns facilitates handling of the gantry in its stowed configuration.

The or each leg assembly may further comprise stop means which engage with the beam when the leg assembly is in its second, deployed, position.

The stop means may be of a resiliently compressible material such that when the or each leg assembly is in its fully deployed position the stop means is operative to damp movement or vibration of the gantry.

The stop means may be generally cylindrical or generally conical.

The stop means serves as a stop for the first and second leg assemblies to facilitate the deployment of the gantry from its stowed configuration, and also act to damp movement or vibration of the beam in use of the gantry.

The lower leg parts of the first and second leg assemblies may be pivotally mounted for movement between their first, stowed, positions and their second, deployed, positions.

The first and second leg assemblies may comprise further stop means for impeding movement of the lower leg parts towards their first, stowed, positions when the lower leg parts are in their second, deployed, positions.

The further stop means may be configured to impede movement of the lower leg parts towards their second, deployed, position when they are in their first, stowed, position.

The further stop means may be biased towards a position in which movement of the lower leg parts is impeded.

Biasing the further stop means in this way impedes accidental movement of the lower leg parts, as the stop means is automatically engaged to impede such accidental movement and must be manually disengaged before any movement of the lower leg parts can occur.

The second leg assembly may be pivotally mounted to the second end of the beam by means of a shaft on which a wheel is mounted.

This arrangement further assists in the handling of the gantry when it is in the stowed configuration, as the wheel that is located at the first or second end of the beam engages with the ground such that the gantry can be moved on the wheel rather than having to be lifted or dragged.

The lower leg parts may be mounted between generally parallel plates, which parallel plates are mounted on opposed sides of the upper leg part.

The upper and lower leg parts of the first or second leg assemblies may be of a box-section material having a first dimension which is greater than a second dimension, and the lower leg parts may be rotated through 90 degrees with respect to the upper leg parts such that when the first or second leg assembly is assembled a gap exists between the plates and the lower leg parts.

Using the box-section material for both the upper and lower leg parts reduces the bill of materials cost of the gantry, as the material can be purchased in bulk quantities. The 90 degree rotation of the lower leg parts with respect to the upper leg parts ensures that the side of the lower leg parts with the shorter dimension is received between the parallel plates, which are spaced apart by a distance approximately equal to the longer dimension of the material. Thus, a natural clearance gap is formed between the lower leg parts and the parallel plates, permitting unimpeded movement of the lower leg parts.

In an alternative embodiment the gantry may comprise a tripod which is attachable to a second end of the beam.

The tripod may be attachable to the second end of the beam by means of an engagement part of the tripod, the engagement part being rotatable such that the gantry can rotate about the tripod.

BRIEF DESCRIPTION OF THE DRAWINGS

Embodiments of the invention will now be described, strictly by way of example only, with reference to the accompanying drawings, of which.

DESCRIPTION OF THE EMBODIMENTS

Figure 1:
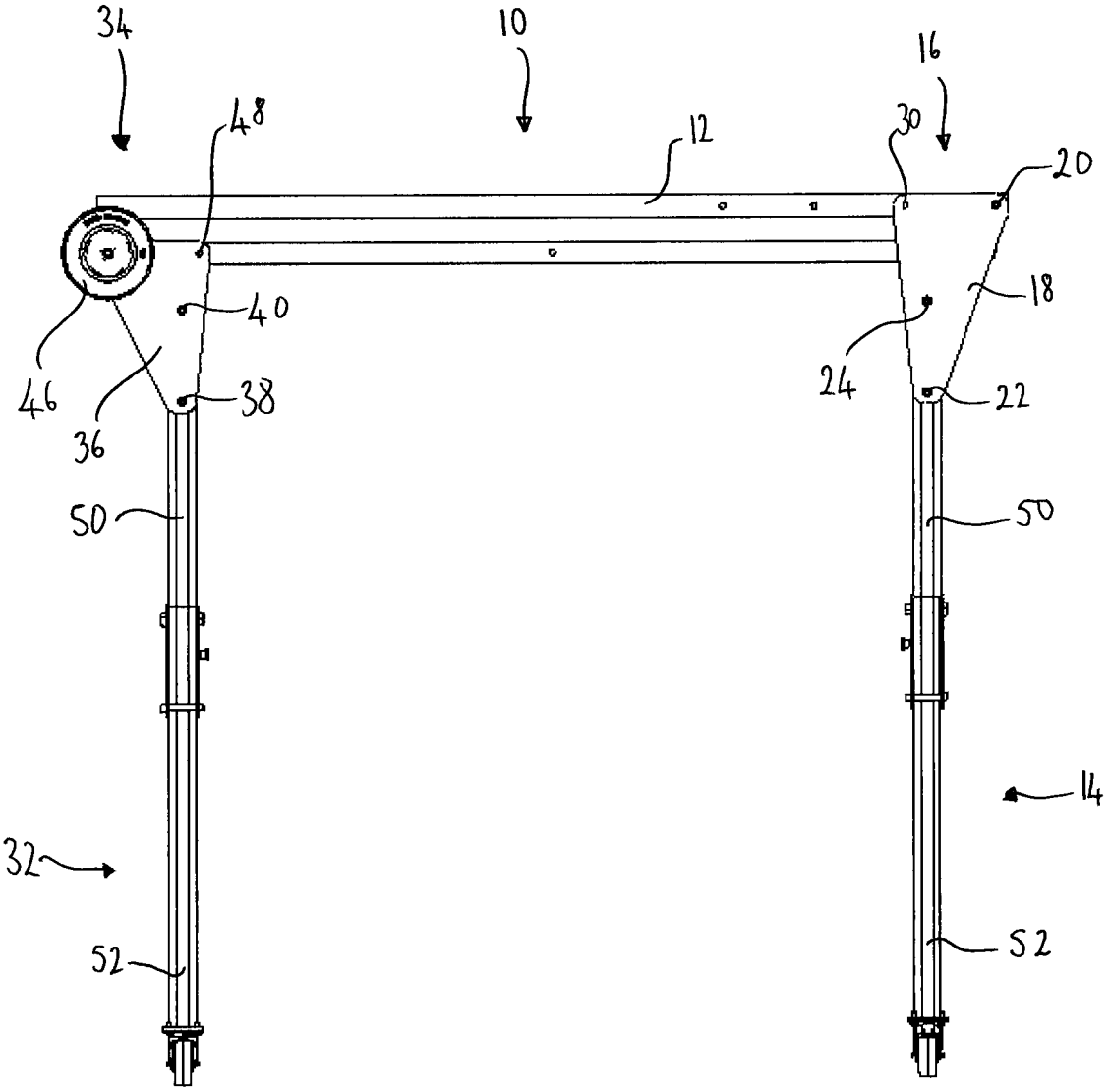
FIG. 1 is a schematic representation of a gantry according to an embodiment of the present invention in a fully deployed configuration.

Referring to FIG. 1, a gantry according to an embodiment of the present invention is shown generally at 10. The gantry 10 has a beam 12 which, when the gantry 10 is in the fully deployed configuration illustrated in FIG. 1 adopts a generally horizontal orientation.

A first leg assembly 14 is pivotally attached to a first end 16 of the beam 12 by means of a first pair of generally right-angled triangular cheek plates 18. As can be seen most clearly in FIG. 3, the cheek plates 18 are spaced apart and are generally parallel to each other, one of the pair of cheek plates 18 being positioned on one side of the beam 12, and the other one of the pair of cheek plates 18 being positioned on the other side of the beam 12.

A first mounting hole 20 is provided towards the corner of each of the cheek plates 18 that joins the shortest side of the generally triangular cheek plate 18 to the longest side of the generally triangular cheek plate 18. A pin passes through the first mounting hole 20 of the first of the pair of cheek plates 18, though a bore provided at the first end 16 of the beam 12 and through the first mounting hole 20 of the second of the pair cheek plates 18, thereby pivotally mounting the pair of cheek plates 18 to the first end 16 of the beam 12.

A second mounting hole 22 is provided in each of the cheek plates 18 towards the corner of each of the cheek plates 18 that joins the longest side of the cheek plate 18 to the second longest side of the cheek plate 18. A third mounting hole 24 is provided in each of the cheek plates 18 at a position intermediate the second mounting hole 22 and the shortest edge of the cheek plate 18. The second and third mounting holes 22, 24 are used to secure the first leg assembly 14 to the pair of cheek plates 18, by means of bolts 26, 28 which pass through the second and third mounting holes 22, 24 of one of the pair of cheek plates 18, through corresponding bores provided in the first leg assembly 14 and through the second and third mounting holes 22, 24 of the other of the pair of cheek plates 18. Each of the bolts 26, 28 is received by a complementary nut, thus securing the first leg assembly 14 in position between the cheek plates 18, thereby pivotally mounting the first leg assembly 14 to the beam 12.

A fourth mounting hole 30 is provided towards the corner of each of the cheek plates 18 that joins the shortest side of the cheek plate 18 to the second longest side of the cheek plate 18. In the fully deployed configuration illustrated in FIG. 1, the fourth mounting holes 30 of each of the cheek plates 18 align with a bore which extends through the beam 12. A retaining pin is inserted through the fourth mounting holes 30 of the cheek plates 18 and the bore of the beam 12 to retain the first leg assembly 14 in the upright position illustrated in FIG. 1.

A second leg assembly 32 is pivotally attached to a second end 34 of the beam 12 by means of a second pair of generally right-angled triangular cheek plates 36. The cheek plates 36 are generally similar to the cheek plates 18, in that they are spaced apart and generally parallel to one another, being positioned on opposed sides of the beam 12. Each of the cheek plates 32 is provided with a first mounting hole (not shown) provided towards the corner of the cheek plate 36 that joins the shortest side of the generally triangular cheek plate 36 to the longest side of the generally triangular cheek plate 36. A second mounting hole 38 is provided in each of the cheek plates 36 towards the corner of each of the cheek plates 36 that joins the longest side of the cheek plate 36 to the second longest side of the cheek plate 36.

A third mounting hole 40 is provided in each of the cheek plates 36 at a position intermediate the second mounting hole 38 and the shortest edge of the cheek plate 36. The second and third mounting holes 38, 40 are used to secure the second leg assembly 32 to the pair of cheek plates 36, by means of bolts 42, 44 which pass through the second and third mounting holes 38, 40 of one of the pair of cheek plates 36, through corresponding bores provided in the second leg assembly 32 and through the second and third mounting holes 38, 40 of the other of the pair of cheek plates 36. Each of the bolts 42, 44 is received by a nut, thus securing the second leg assembly 32 in position between the cheek plates 36.

The second leg assembly 32 is pivotally attached to the second end 34 of the beam 12 by means of an axle or shaft on which a first wheel 46 is mounted. The axle or shaft passes through the first mounting hole of a first one of the pair of cheek plates 36, through a bore provided at the second end 32 of the beam 12 and through the first mounting hole of the second one of the pair of cheek plates 36. A second wheel 46 is mounted on a distal end of the axle or shaft and serves to hold the axle or shaft in position.

Each of the cheek plates 36 is provided with a fourth mounting hole 48 towards the corner of each of the cheek plates 36 that joins the shortest side of the cheek plate 36 to the second longest side of the cheek plate 18. In the fully deployed configuration illustrated in FIG. 1, the fourth mounting holes 48 of each of the cheek plates 36 align with a bore which extends through the beam 12. A retaining pin is inserted through the fourth mounting holes 48 of the cheek plates 36 and the bore of the beam 12 to retain the second leg assembly 32 in the upright position illustrated in FIG. 1.

Each of the cheek plates 18, 36 is provided, on its inner face, with a stop of a resilient compressible material such as rubber or a resilient compressible plastics material. The stops may be generally cylindrical or generally conical in shape, for example. The purpose of these stops is twofold: firstly to act as stops for the first and second leg assemblies 14, 32 when they are moved from the stowed position of FIG. 2 to the fully deployed position of FIG. 1 to facilitate the deployment of the leg assemblies 13, 32 by ensuring that the first and second leg assemblies 14, 32 are correctly positioned with respect to the beam 12 so as to align with their respective bores, and secondly to act as dampers in use of the gantry 10 in its fully deployed configuration to damp any movement or vibration of the gantry 10. This damping effect arises from the compression of the resilient compressible stops by the underside of the beam 12 when the beam 12 is in its fully deployed position and the retaining pins are received in the mounting holes 30, 48 and the corresponding bores of the beam 12, which causes the stops to absorb or damp any vibration or movement of the beam 12 in use of the gantry 10.

Figure 2:
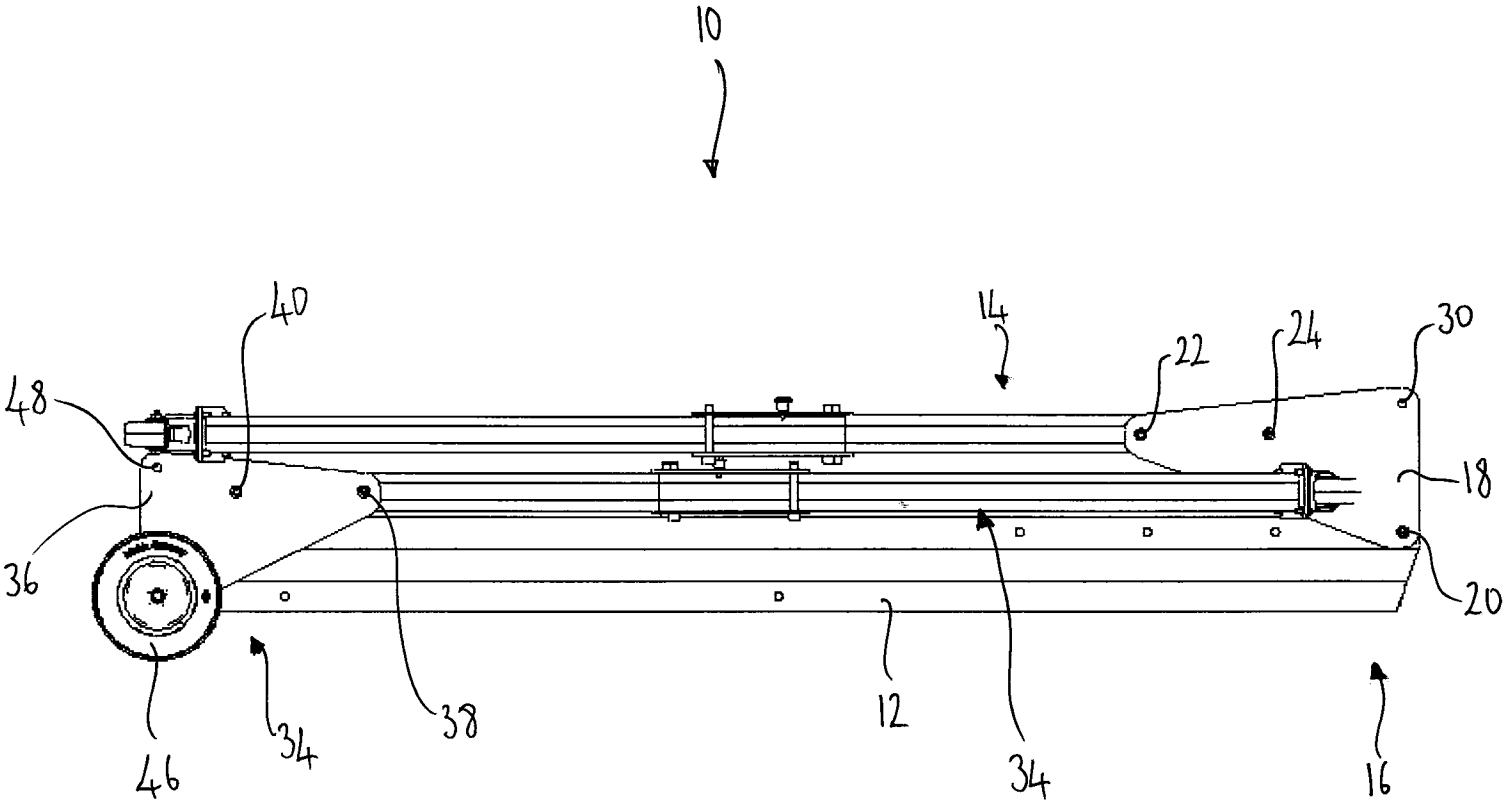
FIG. 2 is a schematic representation of the gantry illustrated in FIG. 1 in a folded configuration.

It will be noted from FIG. 1 that the first and second pairs of cheek plates 18, 36 are not symmetrically mounted on the beam 12, but rather the first mounting holes 20 of the first pair of cheek plates 18 align with a through bore in the beam 12 that is positioned at a higher level (when the gantry 10 is in the fully deployed upright configuration illustrated in FIG. 1) than the bore which receives the axle or shaft that is used to attach the second pair of cheek plates 36 to the second end 32 of the beam 12. In other words, the pivot point of the first leg assembly 14 is offset with respect to the pivot point of the second leg assembly 32. The reason for this is to permit the second leg assembly 32 to be rotated about the axle or shaft to a stowed position, as illustrated in FIG. 2, in which it rests against an upper surface of the beam 12. Similarly, the first leg assembly 14 is able to rotate about the pin passing through the first mounting holes 20 of the first pair of cheek plates 18 to adopt the stowed position illustrated in FIG. 2, in which the first leg assembly 14 overlies the second leg assembly 32. Thus, the gantry 10 can be folded into the stowed configuration illustrated in FIG. 2 for storage or transportation. As will be appreciated from FIG. 2, in this configuration the wheels 46 can engage with the ground to facilitate movement of the folded gantry 10.

The beam 12 may be provided with a retractable handle at one or both ends thereof, to facilitate movement of the gantry 10. Each handle is moveable between a stowed position in which it is received in a hollow at the first or second end 16, 34 of the beam 12, and a deployed position, in which it extends outwardly of the first or second end of the beam 12. The handle is mounted at one end on a shaft which extends between sides of the beam 12. To move the handle from its stowed position to its deployed position it is rotated about the shaft until it abuts against the beam 12, which impedes further rotational movement of the handle about the shaft. To return the handle to its stowed position, it is simply rotated about the shaft in the opposite direction until it is received in the hollow first or second end 16, 34 of the beam 12.

Figure 3:
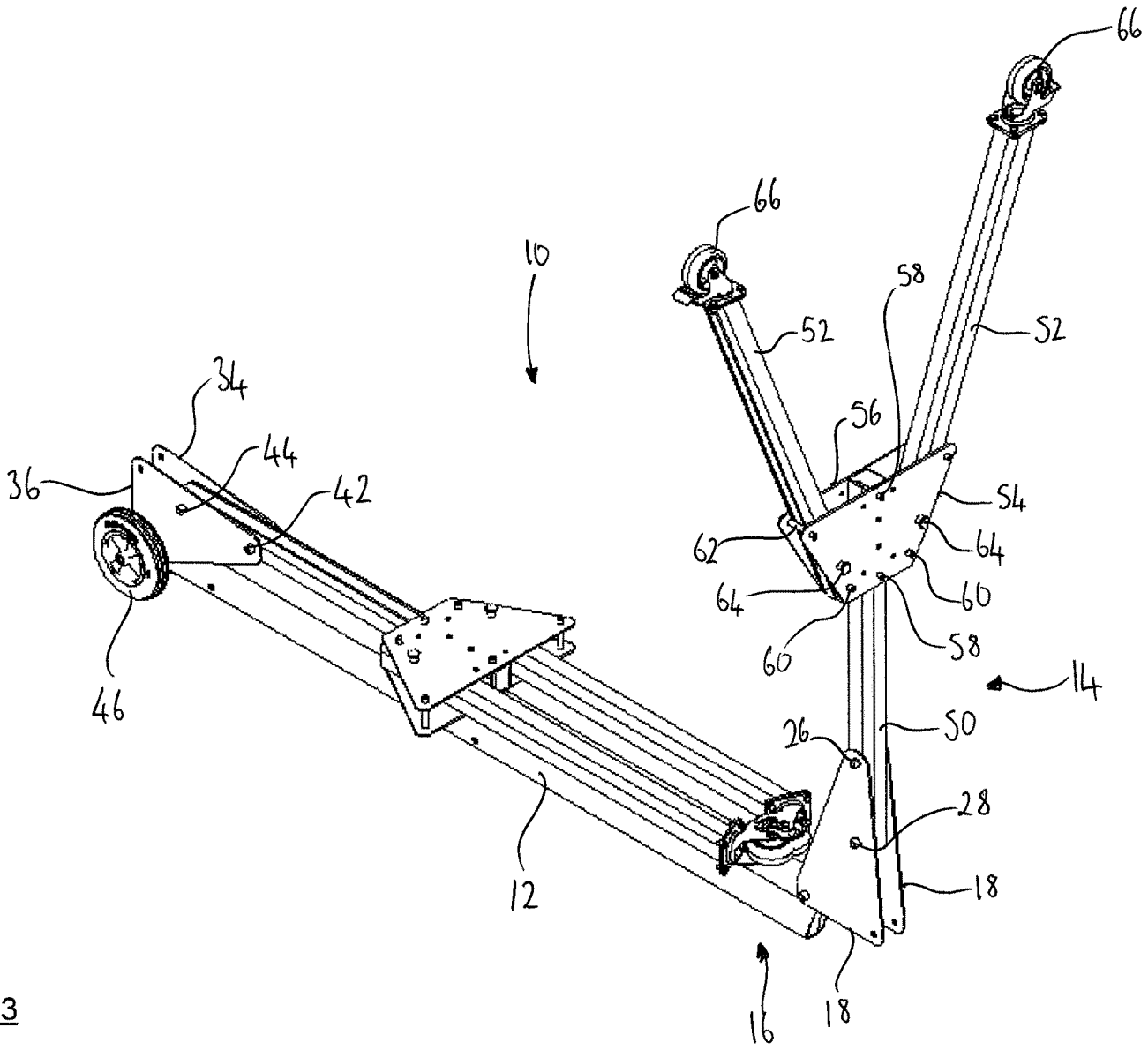
FIGS. 3 and 5 to 8 are schematic representations of the gantry illustrated in FIGS. 1 and 2 at different stages in a transition from the folded configuration shown in FIG. 2 to the fully deployed configuration shown in FIG. 1.

Referring now to FIG. 3, the construction of the first and second leg assemblies 14, 3 will now be explained in more detail.

Figure 4:
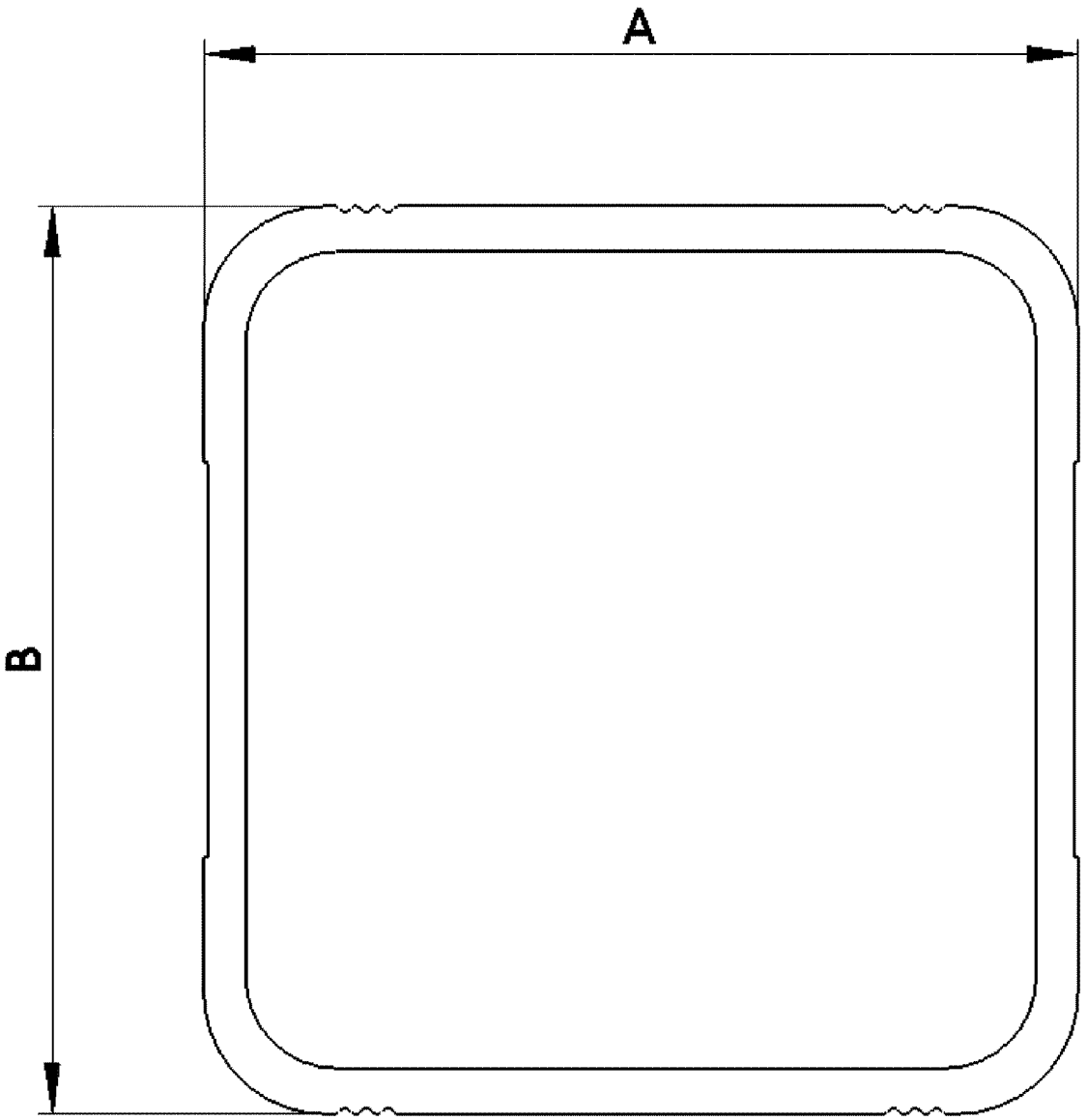
FIG. 4 is a schematic representation of a box section used to make the legs of the gantry of FIGS. 1 to 3 and 5 to 8.

The first leg assembly 14 is made up of an upper leg part 50 and a pair of outwardly extendable lower leg parts 52. The upper leg part 50 is made of a box section material such as aluminium or steel. As is shown in FIG. 4, the box section material has a first dimension A (in this example the width of the box section material) that is slightly smaller than a second dimension B (in this example the depth of the material). The upper leg part 50 and the lower leg parts 52 are made of the same box section material, but the material of the lower leg parts 52 is rotated through 90 degrees with respect to that of the upper leg part, for reasons that will be explained below.

First and second generally trapezoidal plates 54, 56 are attached to opposed sides of the upper leg part 50 by means of bolts 58, such that the first and second plates 54, 56 are generally parallel to each other and spaced apart. The plates 54, 56 are provided with mounting holes which align with bores of the upper leg part 50, and the bolts pass through the mounting holes of the first plate 54, the bores of the upper leg part 50 and the mounting holes of the second plate 56, and are secured by complementary nuts, to hold the first and second plates 54, 56 in position on the upper leg part 50.

The upper leg part 50 may be provided with a plurality of spaced bores to permit coarse adjustment of the height of the gantry 10 by positioning the first and second plates 54, 56 a position at which the mounting holes of the plates 54, 56 align with bores of the upper leg part and securing them in positioning using bolts which pass through the mounting holes and the bores. It will be appreciated that positioning the first and second plates so that their mounting holes align with bores provided in an upper portion of the upper leg part will cause the gantry, when fully deployed, to be of lesser height than if the first and second plates 54, 56 had been positioned and secured using bores provided in a lower portion of the upper leg part 50.

The lower leg parts 52 are pivotally mounted to the plates 54, 56 by means of shafts 60 which pass through mounting holes provided towards the shorter edge of each of the trapezoidal plates 54, 56 and through bores in upper end portions of the lower leg parts 52, which align with the mounting holes. Thus, the lower leg parts 52 are received between the first and second generally trapezoidal plates 54, 56 and are mounted for pivotal movement about the shafts 60 between a first, stowed, position and a second, deployed, position.

As the box section material of the lower leg parts 52 is rotated through 90 degrees with respect to that of the upper leg part 50, a small clearance gap is formed between the outer surfaces of the lower leg parts 52 and the inner surfaces of the first and second plates 54, 56, to permit unimpeded movement of the lower leg parts 52 between the stowed and deployed positions. It will be appreciated that the use of such box section material for both the upper leg part 50 and the lower leg parts 52 helps to control manufacturing costs, as different materials are not required for different parts of the leg assemblies 14, 32, and the box section material can be purchased in bulk, but the difference between the width and depth dimensions of the box section material allows the required clearance to be provided between the lower leg parts 52 and the first and second plates 54, 56.

The lower leg parts 52 may be biased towards the open (deployed) position shown in FIG. 3 by means of a compression spring or other biasing means. Stops 62 extend between the first and second plates 54, 56 at positions towards the outer edges thereof and serve to restrain the outward movement of the lower leg parts 52 to prevent the gantry 10 from collapsing due to the excessive outward movement of the lower leg parts 52.

When the lower leg parts 52 have adopted their fully open deployed position, as illustrated in FIG. 3, locks 64 are engaged to impede movement of the lower leg parts 52 towards their closed stowed position. The locks 64 are biased by springs or other biasing means towards their locked position in which they impede closing movement of the lower leg parts 52 so that they cannot be accidentally disengaged. In order to disengage the locks 64 a force must be applied to overcome the biasing force of the springs or other biasing means, such that the lower leg parts 52 may be moved towards their stowed position. The locks 64 may be positioned such that they are also engaged when the lower leg parts 52 are in their stowed position to impede opening of the lower leg parts 52. Thus, in order to open the lower leg parts 52 and thus move them towards their deployed position the locks 64 may have to be disengaged.

In the example illustrated in FIG. 3 the lower leg parts 52 terminate in lockable wheels 66, which permit the gantry 10 to be moved when it is in the fully deployed configuration illustrated in FIG. 1. However, it will be appreciated that the wheels 66 could be replaced with spikes, plates or other ground engaging means according to the application for which the gantry 10 is to be used. Alternatively, height adjustable may be provided in place of the lockable wheels 66, to permit fine adjustment of the height of the gantry 10.

As can be seen from FIG. 3, the second leg assembly 32 has generally the same construction as the first leg assembly 14, and thus will not be described in detail here.

The process for deploying the gantry 10 from its stowed or folded configuration as shown in FIG. 2 to its fully deployed configuration as shown in FIG. 1 will now be described with reference to FIGS. 1 to 3 and 5 to 8.

Figure 5:
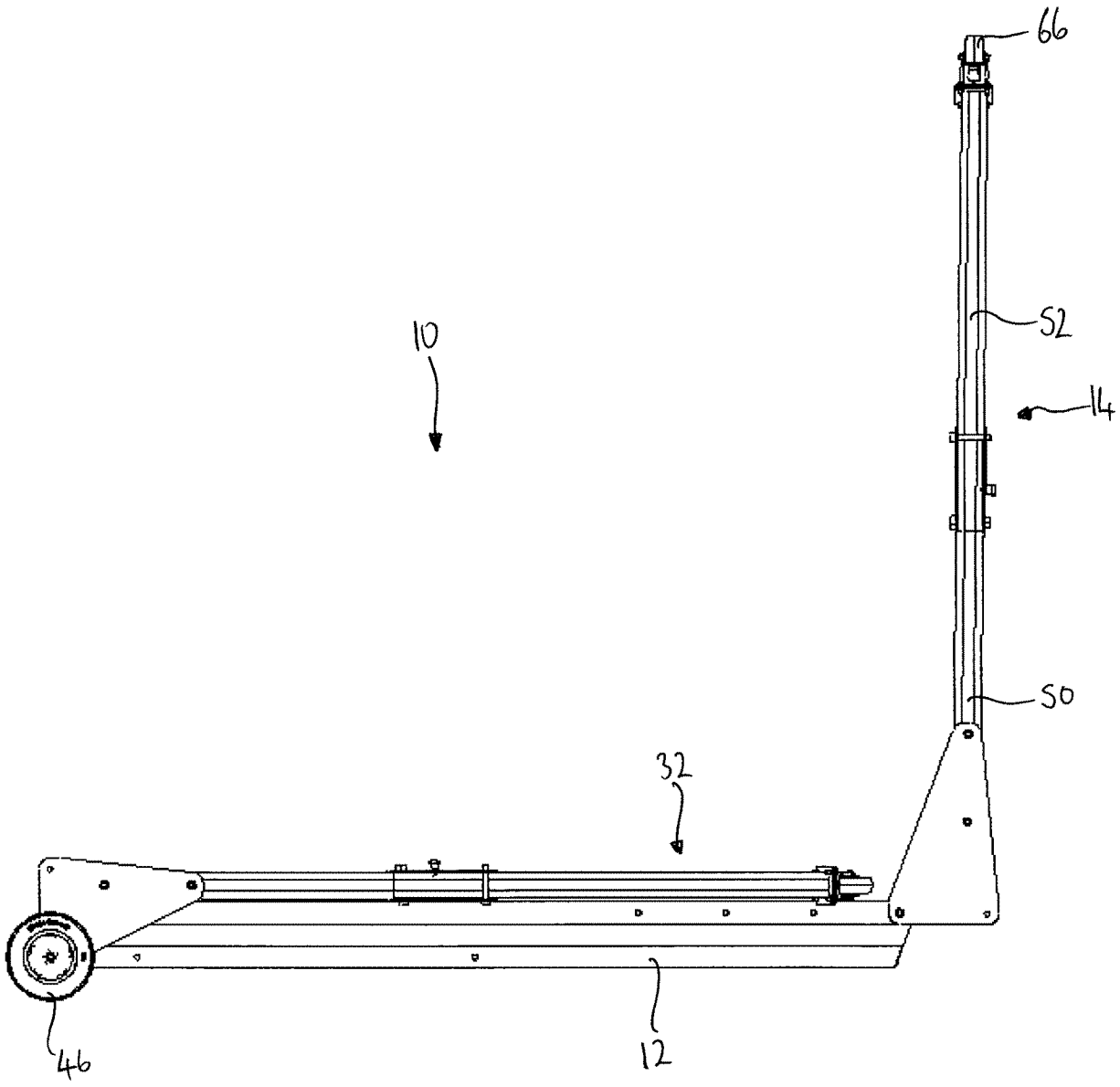

In a first step, the folded gantry 10 is placed on a flat level surface with the wheels 46 engaging with the surface. The first leg assembly 14 is then lifted and rotated to a generally vertical position, as shown in FIG. 5. The locks 64 are disengaged if necessary and the lower leg parts 52 are then opened to their fully open deployed position, as shown in FIG. 3, causing the locks 64 to be engaged to lock the lower leg parts 52 in position and prevent them from closing.

Figure 6:
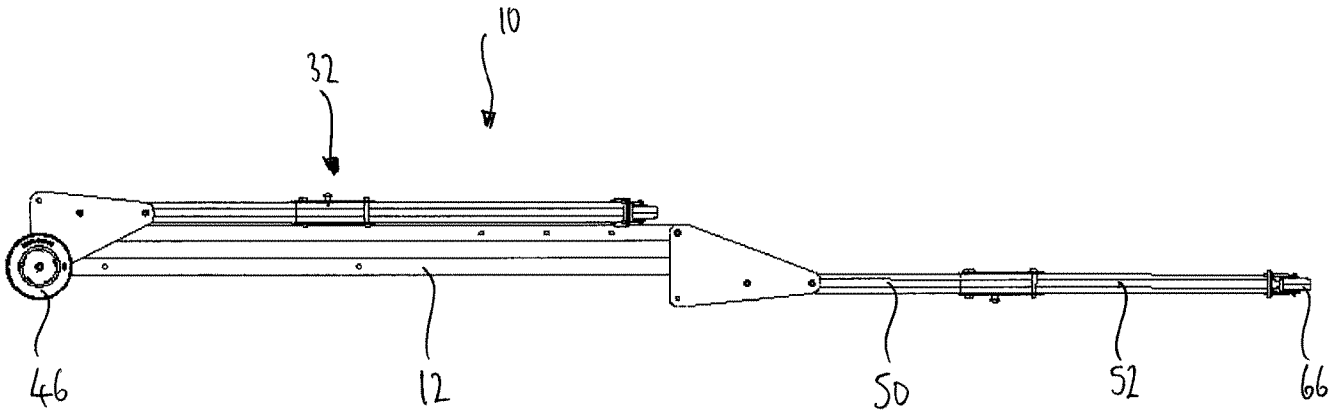
Figure 7:
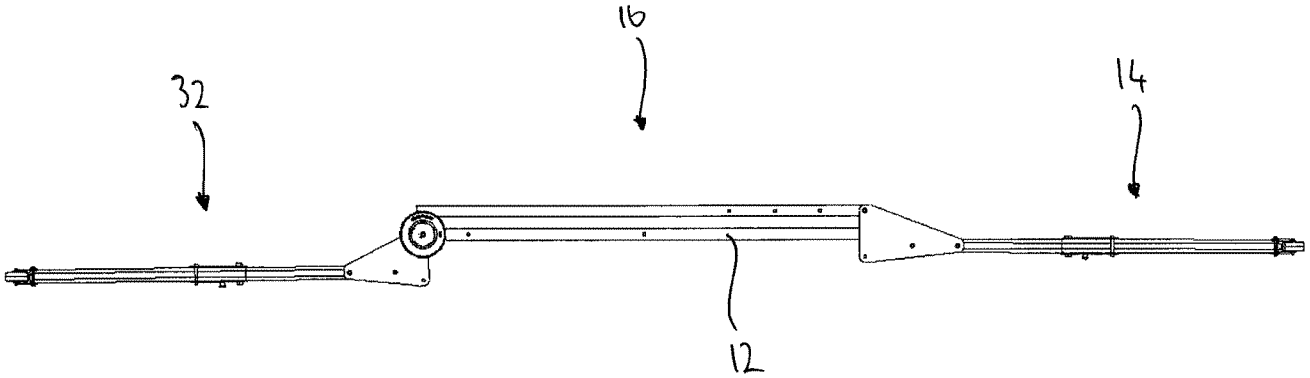

With the lower leg parts 52 locked in their fully open deployed position the first leg assembly 14 can be rotated further until the lower leg parts 52 rest on the surface, as shown in FIG. 6. The steps outlined above can then be repeated for the second leg assembly 32, such that on their completion the lower leg parts 52 of both the first and second leg assemblies 14, 32 rest on the surface, as shown in FIG. 7.

Figure 8:
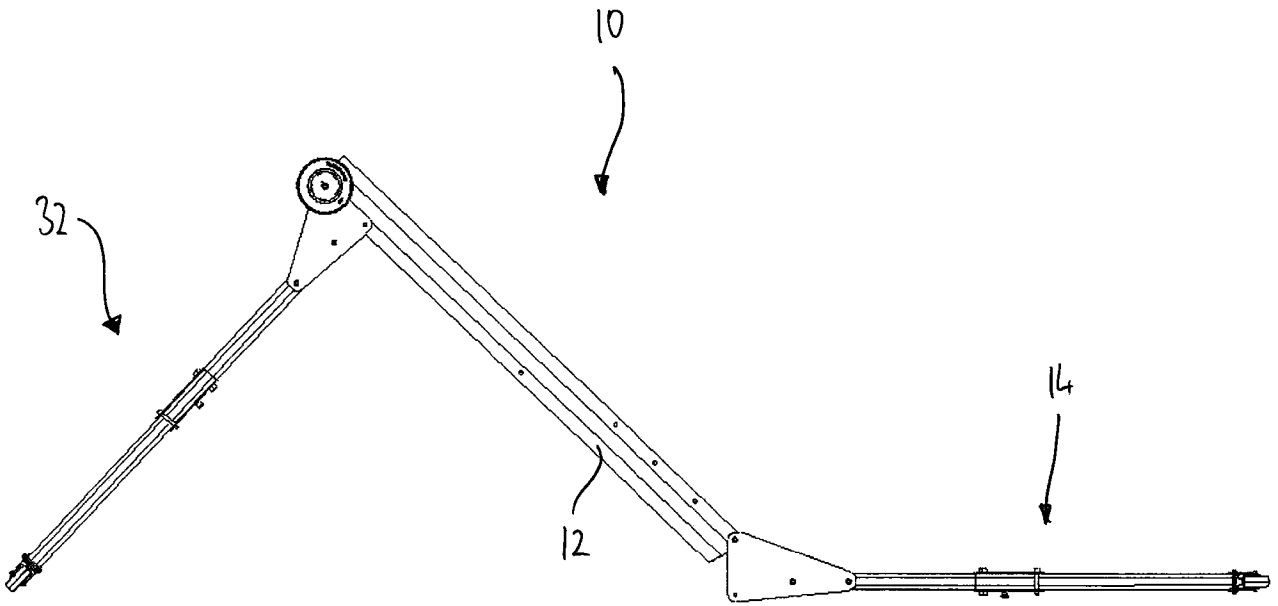

As is shown in FIG. 8, one end of the gantry 10 is then rotated until the beam 12 meets the resilient stop located on the inner face of the one of the cheek plates 18, 36. In the example shown in FIG. 8 the first end 16 of the beam 12 is rotated in a clockwise direction about the pin that passes through the mounting hole 20, causing the second leg assembly 32 to rotate about the axle or shaft on which the wheels 46 are mounted, until the underside of the beam 12 comes into contact with the stops located on the inner faces of the cheek plates 36. Once the beam 12 has reached this position a retaining pin is inserted through the fourth mounting holes 48 in the cheek plates 36 and the aligned bore in the beam 12 to secure the second leg assembly 32 in its deployed position.

The gantry 10 is then pivoted about the point at which the wheels 66 contact the surface to cause the first leg assembly 14 to rotate about the pin which passes through the mounting hole 20, until the underside of the beam 12 comes into contact with the resilient stop(s) provided on the inner faces of the cheek plates 18. Once the beam 12 has reached this position a retaining pin is inserted through the fourth mounting hole 30 in the cheek plates 18 and through the aligned bore of the beam 12 to secure the first leg assembly 14 in its deployed position.

Alternatively, where space is limited, as a first step the first leg assembly 14 may be rotated through 270 degrees to its fully deployed position (as shown in FIG. 1) and secured in position by inserting the retaining pin through the fourth mounting holes 30 and the corresponding bore in the beam 12. The locks 64 can then be disengaged to deploy the lower leg parts 52, as described above. The second leg assembly 32 is then deployed by rotating it through 270 degrees to its fully deployed position (as shown in FIG. 1) and securing it in position by inserting the retaining pin through the fourth mounting holes 48 and the corresponding bore of the beam 12, and the lower leg parts 52 of the second leg assembly are deployed.

Figure 9:
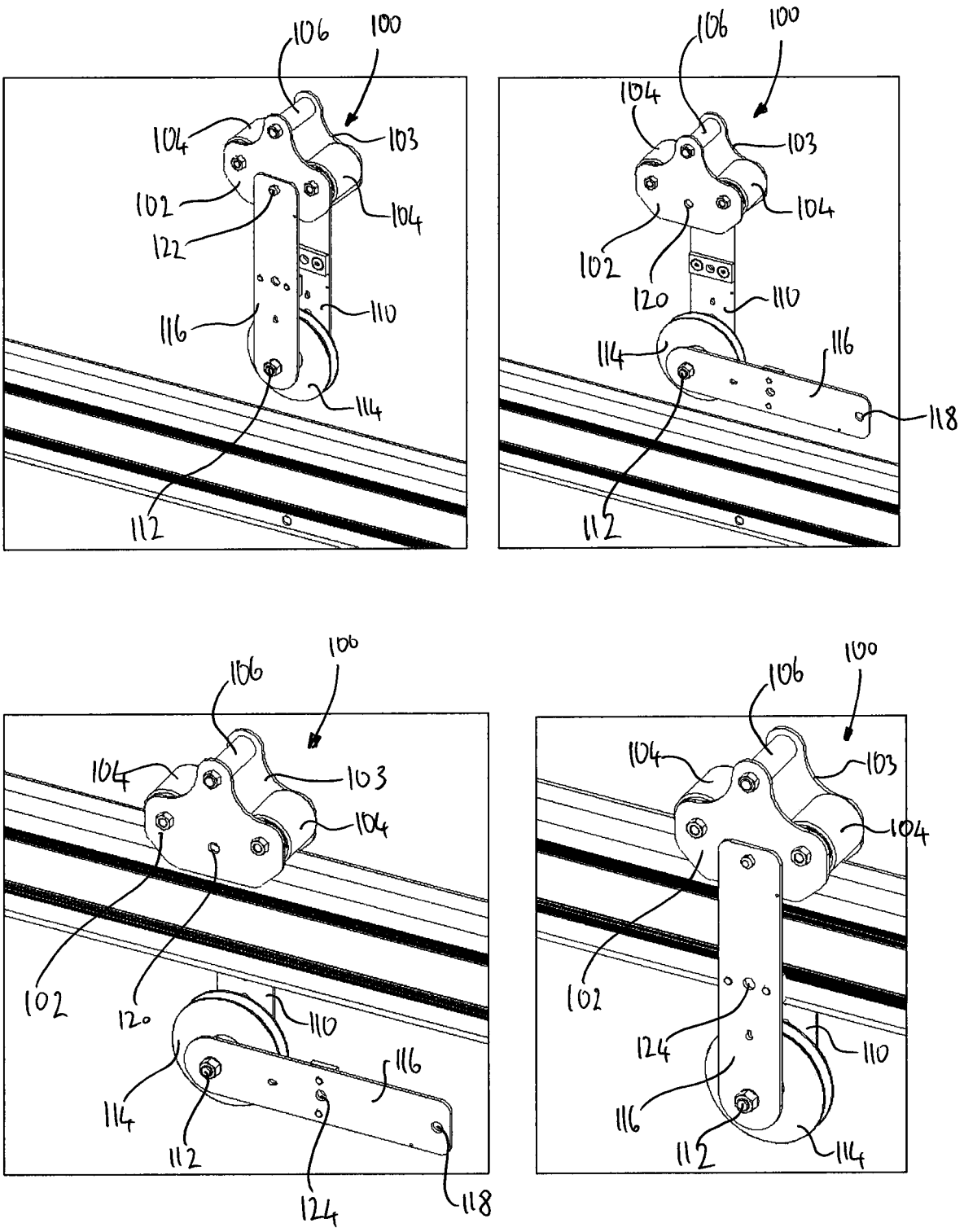
FIG. 9 is a schematic illustration of a trolley for a hoist which may be attached to a beam of the gantry of FIGS. 1 to 3 and 5 to 8.

Referring now to FIG. 9, a trolley for mounting on the beam 12 of the gantry 10 is shown generally at 100. The trolley 100 is made up of two generally parallel spaced plates 102, 103 between which rollers 104 and a handle 106 are mounted. The rollers 104 are mounted for rotation on shafts to allow the trolley 100 to move along the beam 12 of the gantry 10, when the trolley 100 is mounted on the beam 12.

A portion 110 of the rearmost plate 103 of the spaced plates 102, 103 extends downwardly of the rearmost plate 103, and supports an outwardly extending shaft 112 on which a pulley wheel 114 is rotatably mounted in this example. It will be understood that an alternative load or hoist mounting point, such as a masterlink or the like, could be provided in place of the pulley wheel 114. A moveable plate 116 is also mounted for rotation about the shaft 112 such that it is able to move between an open position for engaging or disengaging the trolley 100 with the beam 12 and a closed position for securing the trolley 100 to the beam.

In the closed position of the moveable plate 116, a hole 118 in an upper part of the moveable plate 116 aligns with corresponding holes 120 in the spaced plates 102, and a pin 122 is received in the aligned hole 118 and the aligned holes 120 of the spaced plates 102, to secure the moveable plate 116 to one of the plates 102, thereby securing the moveable plate 116 in its closed position.

To install the trolley 100 on the beam 12 the pin 122 is removed and the moveable plate 116 is rotated to its open position. The trolley 100 is then positioned on the beam 12 with the rollers 104 engaging with the upper surface of the beam 12. Once the rollers 104 are correctly engaged with the upper surface of the beam 12 the moveable plate 116 is rotated to its closed position and the pin 122 is replaced, thereby securing the moveable plate 116 in its closed position and the trolley 100 to the beam 12. To disengage the trolley 100 from the beam 12 the process outlined above is reversed.

In use of the gantry 10, it can be transported in its folded or stowed configuration, as shown in FIG. 2, to a work location, where it is deployed as described above. The trolley 100 is installed on the beam 12 and a winch may be attached by a quick-release bracket to the plates 56, 56 of the first or second leg assembly 14, 32, with a cable of the winch passing over a sheave mounted between one of the pairs of cheek plates 18, 36 and over the pulley wheel 114. The trolley 100 is locked in a desired position on the beam 12 by means of a pin which passes through a hole 124 in the plate 116 and engages with the beam 12, to prevent the trolley 110 from being pulled along the beam 12 by the cable. A load to be lifted or lowered, which may be, for example, a workman or a piece of machinery, is then attached to the cable and can be lifted or lowered using the winch. The gantry 10 itself can be moved on its wheels 66, which can be locked when the gantry 10 is in the correct position.

Where a masterlink is provided in place of the pulley wheel 114 and a hoist replaces the winch, the trolley 110 and the load can be moved along the beam 12 towards either of the first and second leg assemblies.

Figure 10:
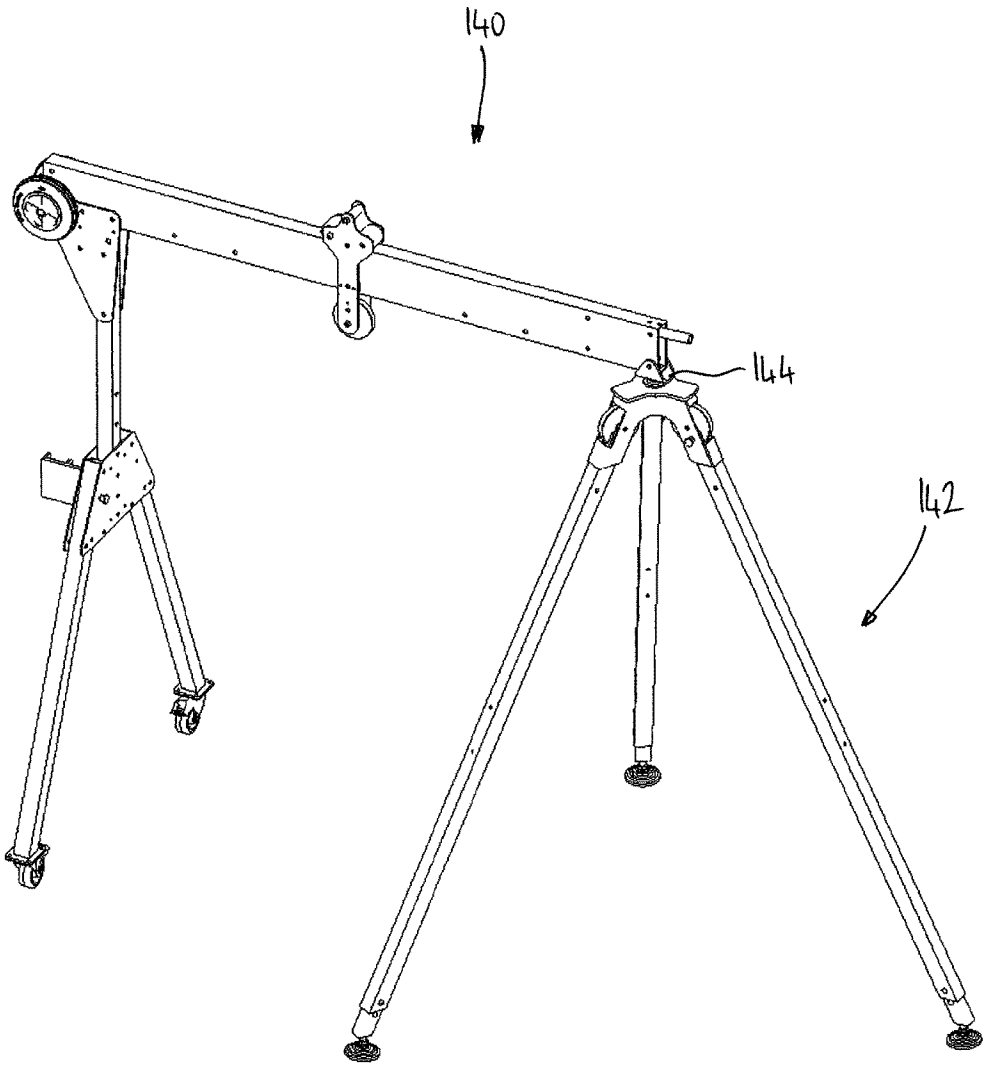
FIG. 10 is a schematic perspective view of a gantry according to an alternative embodiment of the present invention in a fully deployed configuration.

In an alternative embodiment, shown generally at 140 in FIG. 10, a tripod 142 may replace the first leg assembly 14, in which case an engagement part 144 of the tripod 142 may be attached to the first end 16 of the beam 12 by means of a pin that passes through a bore of the tripod 142. In certain embodiments the engagement part of the tripod 142 may be rotatably mounted on the tripod 142 to facilitate rotation of the entire gantry 10 about the tripod 142, for example to move a workman away from danger quickly. In this embodiment the second leg assembly 32 is able to fold into the stowed position shown in FIG. 2 for storage or transport, but the tripod 142 may be detachable from the first end 16 of the beam for storage or transport of the gantry 10.

It will be appreciated that the gantry provides improvements over known gantry arrangements, in that it can be folded down for storage or transport, and quickly and safely transformed to a fully deployed configuration when required.

The invention claimed is:

1. A foldable gantry comprising:

a beam arranged as a rail to carry a trolley of a hoist, a first leg assembly, the first leg assembly being pivotally mounted at a first end of the beam such that the first leg assembly can move between a first, stowed, position and a second, deployed, position; and a second leg assembly, the second leg assembly being pivotally mounted at a second end of the beam such that the second leg assembly can rotate through 270 degrees between a first, stowed, position and a second, deployed, position;

wherein the first leg assembly comprises an upper leg part and a pair of lower leg parts extending from the upper leg part to the ground, the lower leg parts being moveable relative to each other between a first, stowed, position and a second, deployed, position; and wherein the upper leg part is provided with a plurality of spaced bores arranged to permit adjustment of a height of the gantry.

2. A foldable gantry according to claim 1, wherein the second leg assembly comprises an upper leg part and a pair of lower leg parts, the lower leg parts being moveable relative to each other between a first, stowed, position and a second, deployed, position.

3. A foldable gantry according to claim 1, wherein the upper leg part of the second leg assembly is provided with a plurality of spaced bores arranged to permit adjustment of a height of the gantry.

4. A foldable gantry according to claim 1, further comprising a first plate and a second plate arranged to attach to opposed sides of the upper leg part by means of bolts, wherein the first and second plates are provided with mounting holes which align with the spaced bores of the upper leg part such that the bolts pass through the mounting holes of the first plate, the spaced bores of the upper leg part, and the mounting holes of the second plate.

5. A foldable gantry according to claim 1, further comprising a trolley mounted to the beam.

6. A foldable gantry according to claim 1, further comprising a lock engaged to impede movement of each of the pair of lower leg parts towards the first, stowed, position when the lower leg parts have adopted the second, deployed, position.

7. A foldable gantry according to claim 1, wherein the first leg assembly is rotated through 270 degrees between the first, stowed, position and the second, deployed, position.

8. A foldable gantry arranged for use in a lifting application, comprising:

a beam;

a first leg assembly; and a second leg assembly;

wherein the first leg assembly is pivotally mounted by means of a first shaft extending through a first end of the beam defining a first pivot point that is a point on the beam which is arranged to remain stationary such that it does not translate relative to the first leg assembly and about which the first leg assembly is arranged to rotate, such that the first leg assembly can move between a first, stowed, position and a second, deployed, position, and the second leg assembly is pivotally mounted by means of a second shaft extending through a second end of the beam defining a second pivot point that is a point on the beam which is arranged to remain stationary such that it does not translate relative to the second leg assembly and about which the second leg assembly is arranged to rotate, such that the second leg assembly can move between a first, stowed, position and a second, deployed, position;

wherein the first leg assembly is arranged to overlap the second leg assembly when the first and second leg assemblies are in their first, stowed, positions; and wherein the second pivot point is offset with respect to the first pivot point such that when the first and second leg assemblies are in their first, stowed, positions the second leg assembly abuts a first side of the beam and the first leg assembly abuts the second leg assembly.

9. A foldable gantry according to claim 8, further comprising a trolley mounted to the beam.

10. A foldable gantry according to claim 8, wherein a length of the second leg assembly between the pivot point of the second leg assembly and a free end of the second leg assembly is less than a length of the beam between the pivot point of the second leg assembly and the first end of the beam.

* * * * *